US007143716B2

(12) United States Patent
Modi

(10) Patent No.: US 7,143,716 B2
(45) Date of Patent: Dec. 5, 2006

(54) PORTABLE WATERCRAFT

(76) Inventor: Christopher Dipak Modi, 2962 Old Yorktown Rd., Yorktown, NY (US) 10598

( * ) Notice: Subject to any disclaimer, the term of this patent is extended or adjusted under 35 U.S.C. 154(b) by 0 days.

(21) Appl. No.: 10/967,710

(22) Filed: Oct. 18, 2004

(65) Prior Publication Data

US 2005/0092227 A1 May 5, 2005

Related U.S. Application Data

(60) Provisional application No. 60/512,000, filed on Oct. 16, 2003.

(51) Int. Cl.
*B63B 7/00* (2006.01)

(52) U.S. Cl. ..... 114/354; 114/347

(58) Field of Classification Search ..... 114/347, 114/354

See application file for complete search history.

(56) References Cited

U.S. PATENT DOCUMENTS

| | | | | |
|---|---|---|---|---|
| 1,935 | A * | 1/1841 | Batchelor | 114/348 |
| 2,600,757 | A * | 6/1952 | Grimston | 114/354 |
| 4,274,170 | A * | 6/1981 | Simpson | 114/347 |
| 6,371,042 | B1 * | 4/2002 | Abernethy et al. | 114/354 |
| 2003/0101921 | A1 * | 6/2003 | Elvestad | 114/354 |

* cited by examiner

*Primary Examiner*—Stephen Avila
(74) *Attorney, Agent, or Firm*—Manu J. Tejwani

(57) ABSTRACT

A lightweight, portable kayak is provided. The kayak is developed around a skeletal frame to which the kayak skin is permanently attached. The kayak skeletal frame may have one or more segments that can be compressed or folded individually. The compressed kayak can be attached or stowed in a backpack for convenient portage by an individual.

20 Claims, 13 Drawing Sheets

A: Skin wrapped around skeleton,
B: Sleeve that keeps ribs in place,
C: Skin seam enclosing skeleton in skin,
D: Cockpit space opening in skin for insertion of cockpit ring A: Hull piece
B: Deckline stitching
C: Deck piece
D: Cockpit hole 1: Skin
2: Wire Skeletal frame
3: Telescoping pole
4: Cockpit brace
5: Cockpit ring A: Skeletal material
B: Folded waterproof material
C: Coil sleeve stitch material

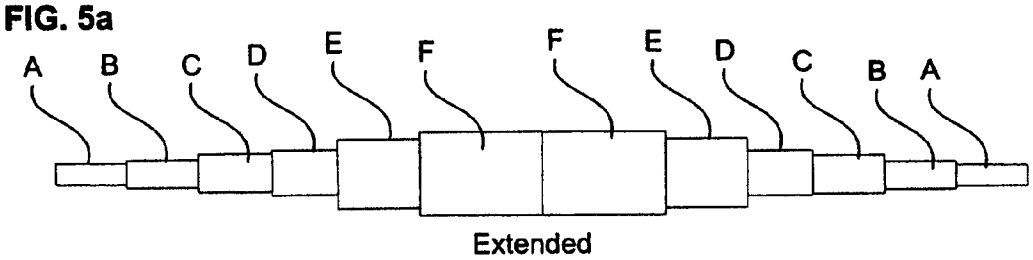
FIG. 5a
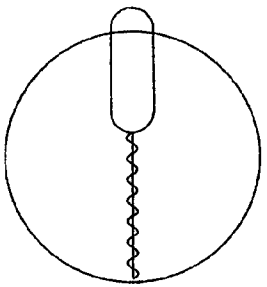
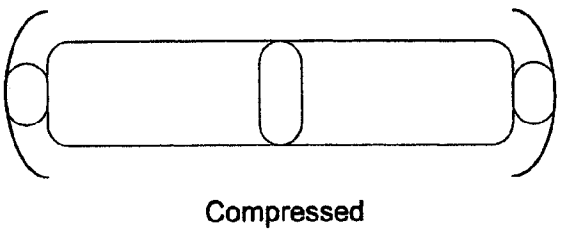
FIG. 5b
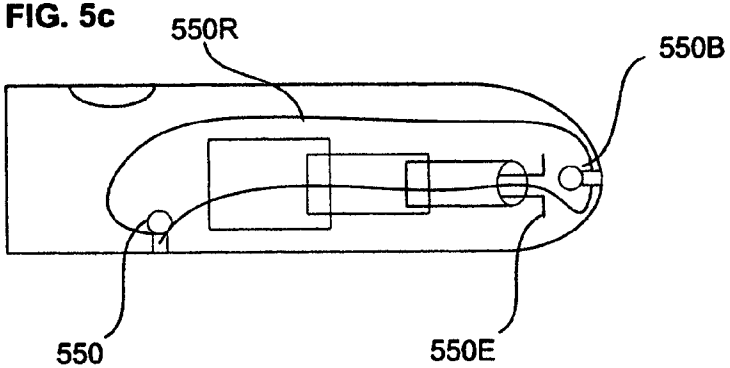
FIG. 5c
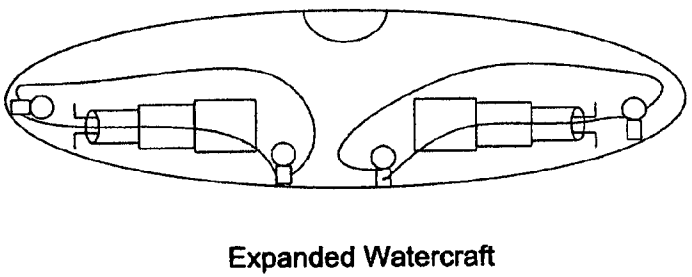

A: Main craft body
B: Floatation arm
C: Floatation device
D: Cockpit

Side View

Top View

PORTABLE WATERCRAFT

CROSS-REFERENCE TO RELATED APPLICATION

This application claims the benefit of United States provisional patent application No. 60/512,000 filed on Oct. 16, 2003, which is hereby incorporated by reference in its entirety herein.

FIELD OF THE INVENTION

The present invention relates to watercraft. More particularly, the invention relates to portable watercraft.

BACKGROUND OF THE INVENTION

Recreational and other users desire lightweight, portable watercrafts. Portable watercrafts such as kayaks and canoes are available commercially, for example, under the brand names Sea Eagle® and Klepper®. See e.g., "Single Klepper Folding Kayaks." Klepper Folding Kayaks AG. <http://www.klepper.com/index2.htm> (15 Nov. 2002) and "The Sea Eagle Explorer 380x." Sea Eagle.com Inc. <http://www.seaeagle.com/canoes/380x.asp> (15 Nov. 2002).

Current designs of portable watercraft are generally based on inflatable tubes. For example, the Sea Eagle kayaks utilize inflatable air chambers for floatation. These watercraft which may be based on inflatable tubes, require bulky air pumps for deploying the watercraft for use. Other commercial watercraft designs use a number of connecting rods for an assembly of a skeleton of frame. A separate skin is draped on the skeleton in the manner of a tent construction. For example, the Klepper Folding kayaks utilize a method of construction similar to that of a tent. A number of poles are first connected together to assemble a kayak skeleton. Then a waterproof skin is draped over which. All of the commercially available portable kayaks are bulky, and take considerable time and effort to assemble at least because of the number of loose individual parts that have to be put together. Also, the weight of these kayaks is sufficiently large to make unaided transport by an individual impractical. For example, a portable kayak sold under the brand name AE Scout, which may be the smallest commercially available one-person portable kayak, is about 12.5'×26" when assembled. However, it weighs approximately 51 lbs, which may be too much for an unaided transport by an individual.

Consideration is now directed toward improving the portability of watercraft. In particular, attention is directed to lightweight watercraft structures that can be compressed and transported easily by an unaided individual.

SUMMARY OF THE INVENTION

A portable seaworthy kayak is provided. The kayak has a unified skeleton frame and skin. The unification of the skeleton frame and skin allows for rapid and easy deployment of the kayak. The skeleton frame is designed so that it can be readily compressed (like a spring) or folded when it is not in use. Time-consuming assembly from unconnected individual parts is avoided. The portable kayaks are made of lightweight material so that they weigh less than 50 lbs and preferable less than 35 lbs each. When compressed or folded the kayaks occupy small volumes. A folded or compressed kayak can be easily stowed, for example, in a backpack, and conveniently ported in the field over rough terrain by an individual.

The kayak skeleton frame may be made from any suitable material, e.g., a high carbon steel. In one embodiment of the invention, the kayak skeleton is wrapped in a waterproofed skin. The skin may be made from ultra lightweight polyester material which is puncture and abrasion resistant. Heavy thread may be sewn around kayak skeleton frame to create sleeves by which the skin is held in place. Alternatively, glue could also be used to permanently attach the skin to the skeletal frame.

The structural strength of the kayak's skeleton frame may be enhanced by a telescoping pole made form suitable high strength materials (e.g., titanium composite material). The telescoping pole, which can extend along the entire length of the skeleton frame, provides rigidity to a deployed kayak. The telescoping pole may have a series of locking sections in a design which allows individual segments of the kayak to be compressed or folded individually.

A relatively rigid cockpit ring may be optionally disposed around a suitable cockpit opening in the deck of the kayak. The cockpit ring may have a folding or telescoping configuration so that it too can be deployed, compressed or folded along with the skeletal frame of the kayak. In some versions of the kayak, the telescoping or foldable skeletal frame of the kayak is configured to accommodate a rigid base or floor in the cockpit space. The base or floor also may be configured to be foldable or compressible consistent with the overall design of the skeletal frame.

An exemplary kayak has dimensions of about 12' long, 3' wide and about a foot high. When compressed, the kayak may occupy a volume of about 24 in×36 in×4.5 in. The exemplary kayak weighs about 29.5 lb.

BRIEF DESCRIPTION OF THE DRAWINGS

Further objects and advantages of the invention will be apparent from a reading of the following description in conjunction with the accompanying drawings in which:

FIG. 5C illustrates an exemplary mechanical rope and pulley arrangement that can be used to operate the telescoping pole of FIGS. 5A and 5B, in accordance with the principles of the present invention.

FIGS. 9*a* and 9*b* show the foldable cockpit base in an expanded state and a collapsed state, respectively.

Throughout the figures, unless otherwise stated, the same reference numerals and characters are used to denote like features, elements, components, or portions of the illustrated embodiments.

DESCRIPTION OF THE INVENTION

Folding structures that can be used as watercraft are provided. A folding structure can be advantageously used, for example, for personal watercraft such as kayaks and canoes.

An inventive kayak may be assembled from a portable kit having a single component (or at most a few separate components). The single component is a compressible/expandable support skeleton or frame. The skeleton design allows the kayak to be compressed to a compact size for convenient portability. The skeleton is designed for simplicity and ease of expansion in the field. In the field, the kayak may be deployed for water use by expanding the compressed skeleton or frame to its fully expanded size or state.

A waterproof skin or fabric is integrated with the skeleton, so that when the latter is expanded to its full size, the skin is pre-disposed or configured on the skeleton to yield a functioning kayak. The kayak skeleton may be designed to have a compressible telescopic or spring-like structure.

Figure 1A:
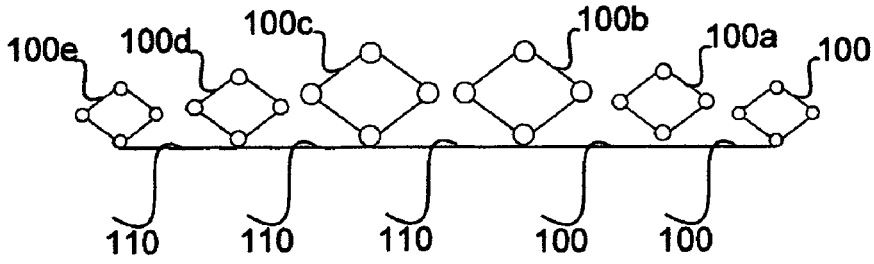
FIGS. 1*a*–1*d* are illustrations of a compressible skeleton or frame of a portable kayak, in accordance with the principles of the present invention.
Figure 1B:
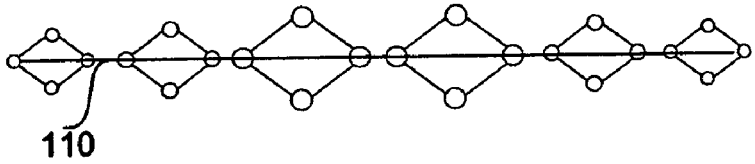

FIGS. 1*a* and 1*b* illustrate the concept of a compressible skeleton or frame 150 for a portable kayak. FIG. 1*a* shows a series of a number of rings (e.g., 100*a*–100*e*). The rings have a circular or oval or other suitable cross-section. The cross-section of each of the various rings is designed to correspond to the cross-section of the kayak at different positions along its length. The central rings may, for example, have a diameter corresponding to the central portions of the kayak. The end rings may, for example, have smaller cross sections corresponding to the nose of the kayak. The rings 100 are connected together by spring-like elements 110. In its folded or compressed state elements 110 have a small length. Thus, the rings 100 are close to each other, and the skeleton 150 has a compact size.

Figure 1C:
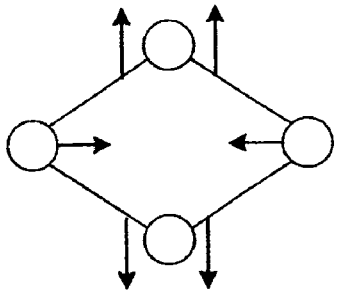
Figure 1D:
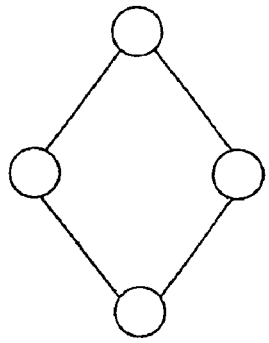

In one embodiment, the individual rings also may be collapsible. This feature may allow further compaction of the folding structure, for example, when the craft is not in use. The collapsible rings may be constructed from curved telescoping tubular segments. Alternatively or additionally, the collapsible rings may be made from curved segments that are hinged together. FIG. 1*c* and 1*d* show, for example, a collapsible ring made from four segments connected by hinges. FIG. 1*c* shows the collapsible ring in its expanded shape. FIG. 1*d* shows with the interconnecting hinges folded or extended giving the collapsible ring a compact shape. It will be understood that the rings of circular cross section shape are shown only for purposes of illustration. The rings may have cross sections of any suitable shape according to the desired cross sectional shape of the portable watercraft (e.g., a flat bottomed shape).

To deploy the kayak for use, elements 110 are extended to place rings 100 along the length of the expanded kayak size as shown in FIG. 1*b*. Rings 100 having a collapsible structure may be expanded to their full shape before or after elements 110 are extended as appropriate or convenient. In the expanded kayak size the rings 100 are spaced apart. The lengths of the elements 110 in their expanded state may be designed so that rings 100 are suitably spaced apart to give the kayak its suitable shape. Locks or other mechanisms may be used be used to keep the elements 110 in their extended state. FIGS. 1*a* and 1*b* show, for example, each element 110 as a single connecting unit. It will be understood that each element 110 may include several units, for example, two units that each run along the opposite sides of the watercraft.

A waterproof fabric or material skin is attached to the skeleton 150. When the skeleton 150 is in its compressed state the skin may be folded, for example, in the manner of an accordion. When the skeleton is expanded the skin may be stretched between the spaced apart rings 100.

Figure 2B:
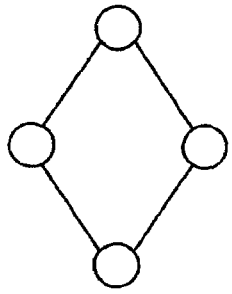
FIGS. 2*a* and 2*b* illustrate a mechanical arrangement, which may be used for connecting elements of compressible skeleton or frame of a portable kayak, in accordance with the principles of the present invention.
Figure 2A:
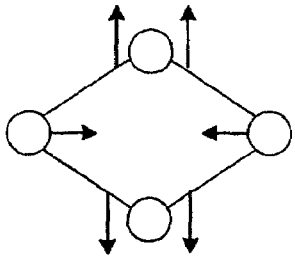

FIGS. 2*a* and 2*b* illustrate a mechanical arrangement, which may be used for connecting elements 110. The figures show, for example, a connecting element 110, which is made of up four rods that are connected by folding hinges. FIG. 2*a* shows, for example, the four rods in a rectangular orientation, which minimizes the length of element 110. FIG. 2*b* shows, for example, an orientation in which pairs of the rods are collinear, providing element 100 with a maximum length. The four rods may have linearly telescopic structures. The telescopic structures may be drawn in or telescoped together to minimize the size of element 100 in its compact state. Conversely, the telescopic structures may be pulled out or extended to maximize the length of element 110 in its expanded state.

Figure 3A:
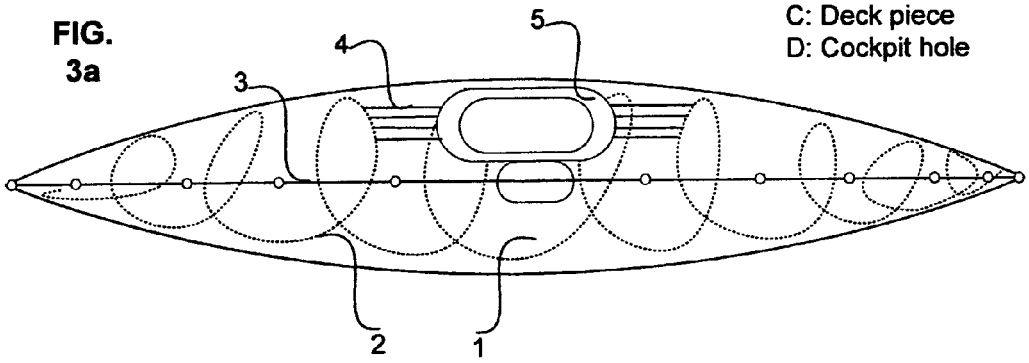
FIG. 3 illustrates a portable watercraft based on a spring-like structure, in accordance with the principles of the present invention.
Figure 3B:
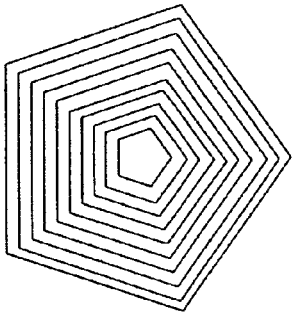

FIG. 3 shows, for example, a portable watercraft based on a helical spring-like structure 2. Helical spring 2 has a generally cylindrical shape whose diameter is tapered down from a central portion toward either end of the watercraft. A keel support device connects the ends of the helical spring. The keel support device may, for example, be a telescoping rod or pole 3. Pole 3 may be a straight rod as shown or may have suitable curvature so that, for example, it runs along the bottom of the watercraft. The watercraft is compressed or expanded by operation of the telescoping rod or pole 3. FIG. 3 shows the watercraft in its expanded state. FIG. 3*b* shows helical spring 2 in a compressed and compact state.

A waterproof skin 1, which is, attached to the helical spring, forms the exterior hull of the watercraft. Waterproof skin 1 is made of flexible material. A range or continuum of hull forms or designs can be used. For example, the hull may be completely open along the top as in the case of a canoe. Alternatively, the hull may completely envelop the watercraft except for a cockpit opening for a paddler as in the case of a kayak (as shown in FIGS. 3*a* and 3*b*). The waterproof skin may be made from any suitable material including, for example, polyesters and other fabrics.

A cockpit ring 5 that is attached to the waterproof skin 1 may define the cockpit opening. The cockpit ring may be made from material that is more heavy or rigid than the material used to make the waterproof skin. The material may be selected to have sufficient rigidity so as to maintain the cockpit opening space around an occupant. The cockpit ring may be permanently attached or may be detachable.

Braces 4 extend from the helical spring portions to the cockpit ring. Braces 4 may support the cockpit ring and also preserve the spacing of the helical spring. Braces 4 may be detachable at one end (e.g., the end which attached to the helical spring, or the end which is attached to the cockpit ring) to allow the watercraft to be compacted. Alternatively braces 5 may be detachable at both ends.

Figure 4A:
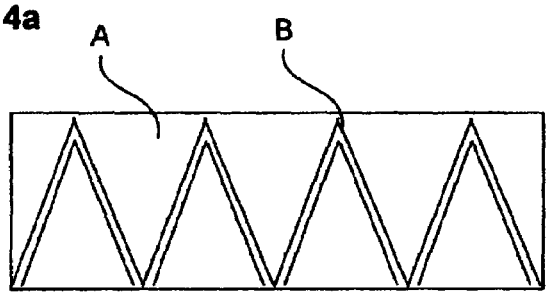
FIGS. 4A and 4B illustrate the helical spring of FIG. 3 which is threaded through a fabric sleeve and attached to an enclosing skin which forms the exterior of the portable watercraft, in accordance with the principles of the present invention.
Figure 4B:
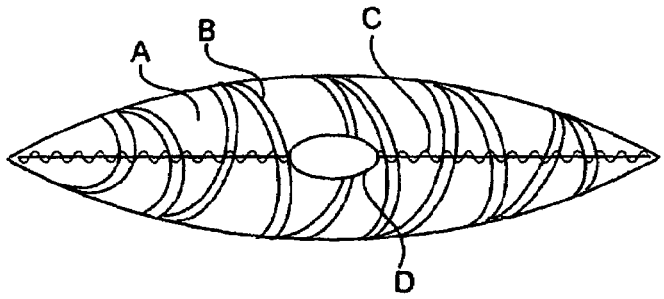

Conventional techniques may be used to attach the skin to the helical spring. For example, the skin may be attached using adhesives, or ties. In one embodiment (FIG. 4*a*), the skin is fabricated from a suitably shaped flat piece of fabric. A zigzag sleeve is formed on the surfaces of the fabric (FIG. 4*a*). The helical spring is threaded through the sleeve. Free ends of the fabric are connected (for example, by stitching, Velcro and/or adhesives) to form an enclosing seam (FIG. 4*b*). FIG. 4C shows a sleeve configuration for securing the kayak skin to frame element. A coil sleeve encases all or some strategic portions of the skeletal frame. The coil sleeve provides a means for attaching the skin to the skeletal frame in a manner which allows the skin to have a proper spacing or stretch when the kayak is expanded. The coils sleeves and the strategic attachment points may be selected to minimize movement outside an acceptable range of motion. The coil sleeve also serves to protect the skeletal frame material from exposure to environmental elements (i.e. water).

Figure 4D:
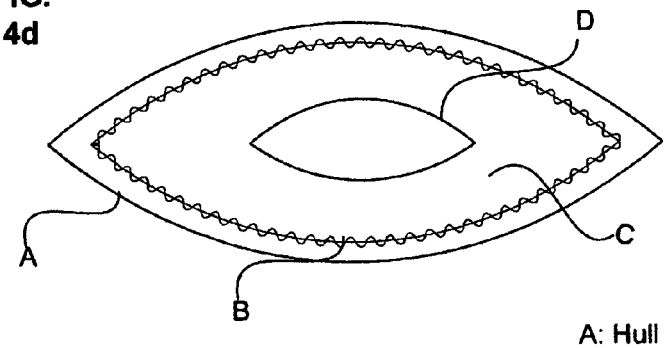
FIGS. 4C and 4D are further illustrations of sleeve configurations for securing the kayak skin and frame elements, and a stitching pattern for securing a skin panel that forms the deck of the kayak, in accordance with the principles of the present invention.
Figure 4C:
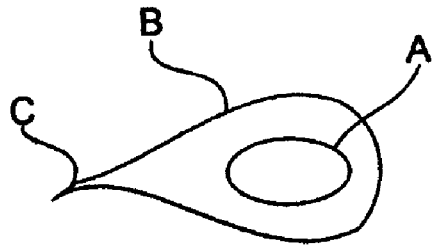
Figure 4C:
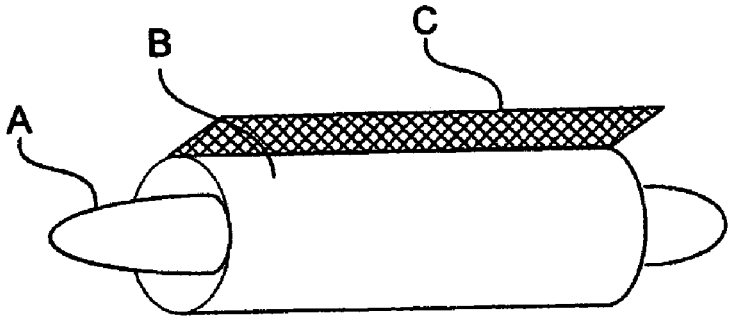

FIG. 4D shows a stitching pattern for securing a skin panel that forms the deck of an exemplary kayak. The kayak has a skin design, which includes a piece of waterproof nylon extending from around the hull up to the deck. A separate piece of waterproof nylon covers the deck portions of the kayak. The two pieces may be affixed to one another with a sewn double seam and any suitable marine grade adhesive or sealant. The simple two-piece method of skinning may reduces the number of seams required to skin the kayak. There may for example, be only three seams (e.g., one which is well above the waterline and two additional seams at the bow and stern).

The spring-like skeleton of the watercraft may be fabricated by shaping material, e.g., metal wire, of suitable elasticity. The spring-like skeleton of the watercraft may be made, for example, from carbon-steel wire helix in the shape of the watercraft. Conventional metalworking techniques that are used to form metal springs may be used to fabricate the skeleton. For example, a model shaped like the desired watercraft may be used as a mandrel or pre-form on which the metal wire is wound in suitably configured grooves. Heat treatment and/or the deformation inherent in wire winding may be sufficient to preserve the skeleton shape after it is removed from the mandrel.

The keel support device of the watercraft may be formed from suitable elastic or expandable material. FIGS. 5A and 5B show, for example, a telescoping pole 500, which may be used as the keel support device of the watercraft. Pole 500 may have a conventional telescoping segment design. Pole 500 may, for example, include coaxial tubes or segments (A, B, C, D, etc.) that extend consecutively form each other when telescopic pole 500 is in its extended state. Releasable pins, for example, spring-biased pins, or other arrangements, for example, snap locks may be used to hold consecutive extended segments in the extended position. On releasing a pin, adjacent segments may be slid or compressed together. In the telescopic pole's compressed state the segments consecutively fit in each other to yield a compact length. End segments A may have suitable mechanical fixtures by which they may are attached to the opposite ends of the helical spring structure of the watercraft. The watercraft is compressed to a compact size by telescoping the pole together. Conversely the watercraft is deployed in its full size by extending the telescopic pole segments. The telescoping pole may be extended or retracted segment-by-segment by hand. Suitable mechanical devices or arrangements may be used for added convenience FIG. 5C shows an exemplary mechanical rope and pulley arrangement, in which rope pulleys 550 and 550B are placed the about the center and the nose portions of the watercraft, respectively. A rope or cord passing through or along the telescopic rod is attached to an end 550E of the telescoping pole (which is forms the nose of the watercraft). The rope or cord passes over pulleys 550A and 550B. Rope of cord 550R may form a closed loop or may be wound on a reel at either end. By suitably turning, for example, pulley 550A, end 550E of the telescoping pole can be made to move toward or away from the center of the watercraft as desired. When the end is moved toward the center, the telescoping pole is retracted or compacted. Conversely, when the end is move away from the center pulley, the telescoping pole is extended.

Figure 6:
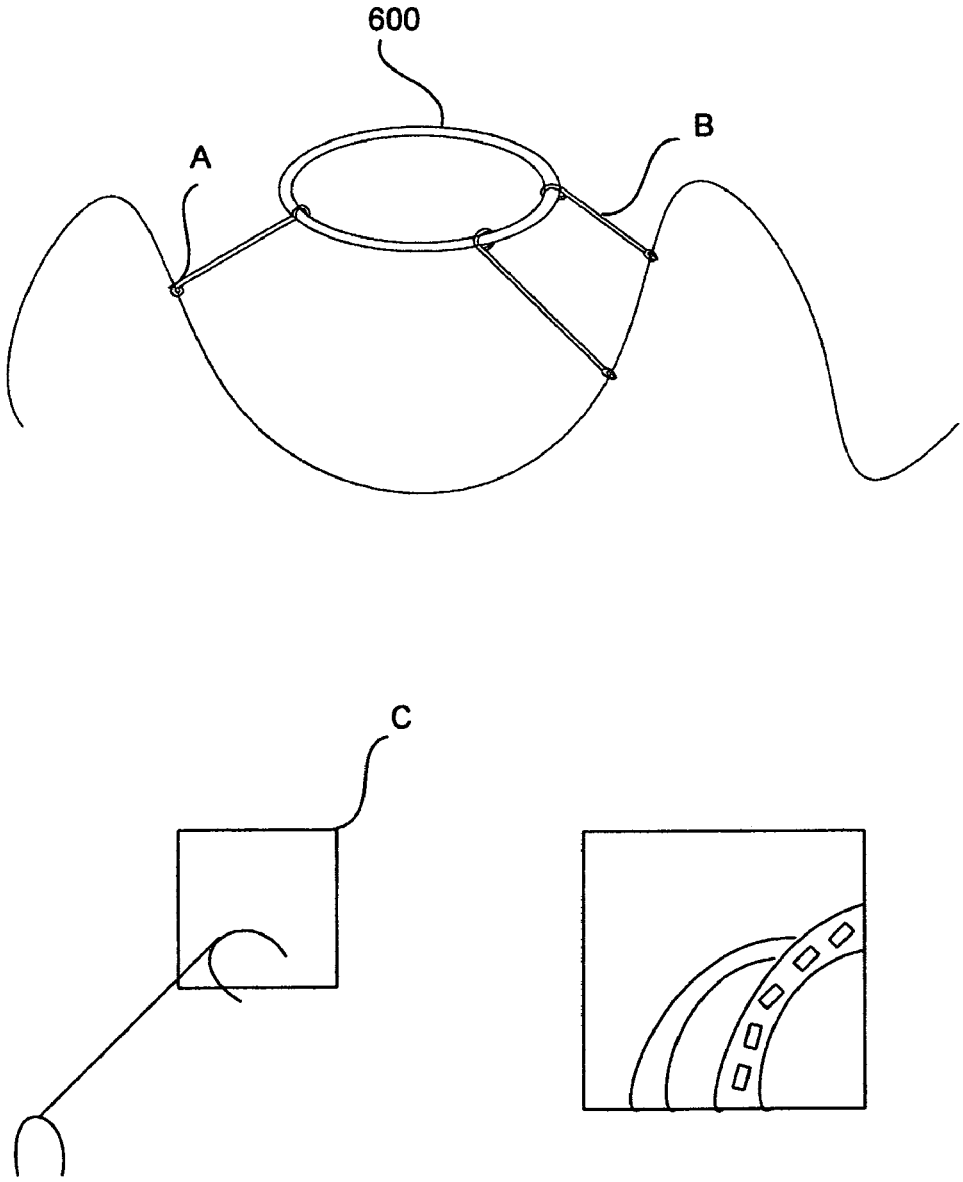
FIG. 6 illustrates exemplary cockpit ring and brace structures that may be incorporated or integrated into in the portable watercraft structure, in accordance with the principles of the present invention.

FIG. 6 shows detailed exemplary cockpit ring and brace structures that may be incorporated or integrated into the watercraft structure, Ring 600 may be formed from any suitable material for example, metals, wood, rigid fabrics, rubber or polymer. Ring 600 is attached or bonded to the cockpit opening to make the opening edges rigid. Ring 600 may be attached to the skin and the helical spring skeleton, for example, by Velcro or adhesives. Other mechanical arrangements may be used. FIG. 6 shows for example, Braces B with locking fixtures A and C. The locking fixtures may, for example, include clasps, clamps or hooks which may be spring loaded. Ring 600 may be permanently attached to the watercraft so that it is part of the compacted water craft or may be a separate component which is attached after the watercraft is extended for deployment.

The materials that are used to fabricate the watercraft may be chosen with consideration, for example, to properties such as structural strength, elasticity, weight and water-resistance. Materials that are suitable for fabricating light-weight and structurally strong skeletons include, for example, metal alloys such as carbon containing steel that can be repeatedly compressed and expanded with minimal loss of structural integrity. Lightweight polyesters (e.g., Heavy Duty Ceconite) may be used to make puncture and abrasion resistant watercraft skins. The keel support (e.g., telescoping pole) may be made of lightweight high strength materials, for example, titanium composites.

An exemplary functional kayak fabricated using the exemplary materials weighs about 30 lbs. By suitable choice of materials the weight may be increased or decreased. The exemplary kayak has dimensions of about 3'×12' in its fully extended state, and of about 3'×3'×4.5 in when compressed.

Figure 8:
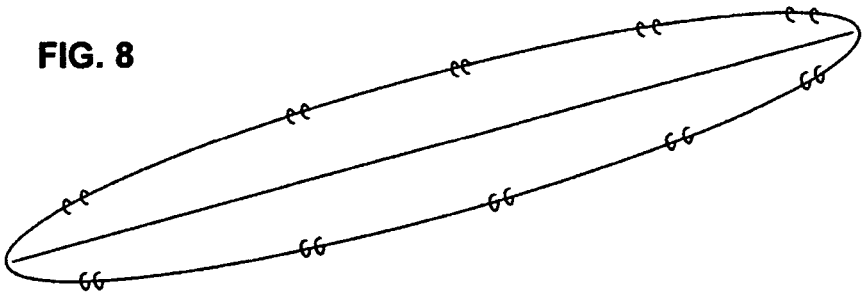
FIG. 8 illustrates support beams or keel support devices that provide structural strength to the portable watercraft, in accordance with the principles of the present invention.

For added structural strength, a portable kayak may optionally include support beams or keel support devices in addition to the telescoping pole (e.g., FIG. 8). These support beams may run the full length of the kayak from the bow to the stem. The support beams may have suitable curves to follow the shape of the kayak. The support beams may be slid into sleeves that run along the skin. In one version, the support beams may be made of several segments, which when not in use may be tied or bundled together (e.g., like tent poles) with a cord (e.g., a bungee cord running through tubular support beams). Alternatively, the support beams may have a telescoping structure, for example, similar to that of pole 500 above.

Figure 7:
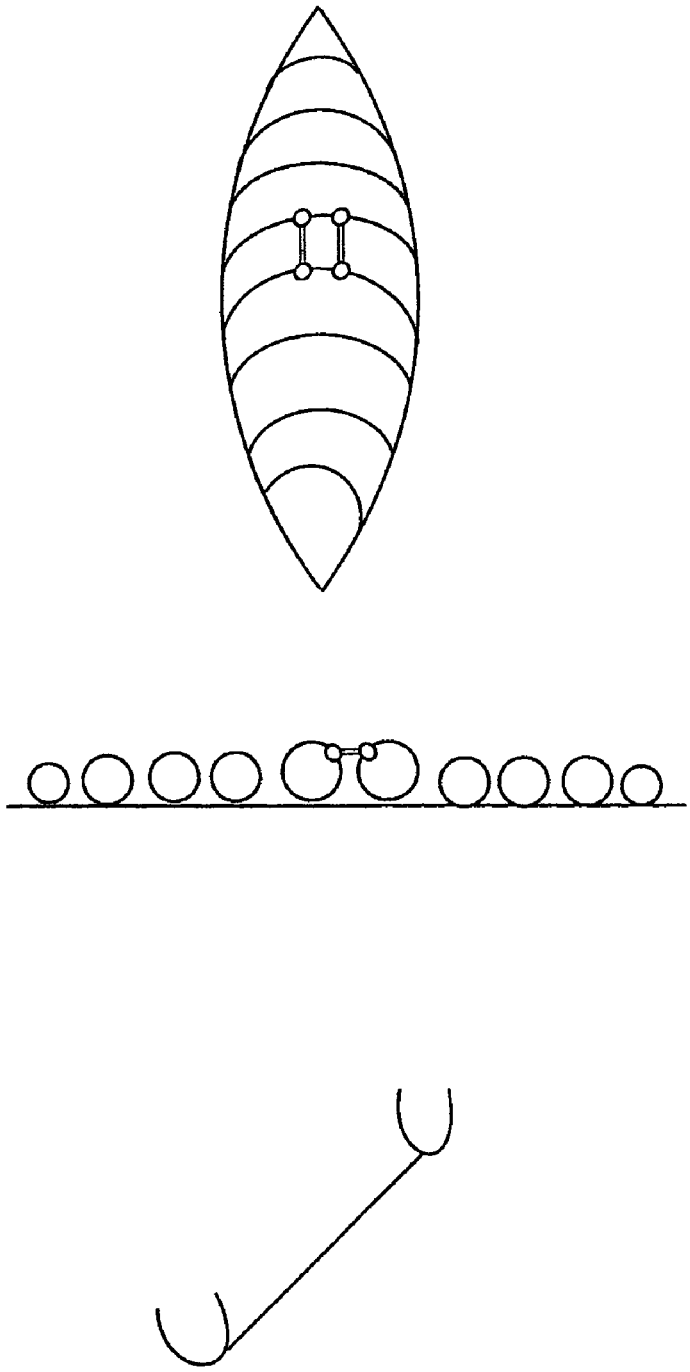
FIG. 7 illustrates a cockpit ring may be used to maintain space in the portable watercraft for a paddler, in accordance with the principles of the present invention.

In one variation of the inventive kayak, an optional cockpit ring (e.g., FIG. 7), which is removable, may be used to maintain the space around the paddler. The ring may be made of metal or hard plastics. The ring may be designed to slip into a Velcro sleeve around the cockpit opening. Braces made of metal or hard plastics that are connectable to the ribs of the kayak (e.g., the skeleton spring turns) may be used to secure the cockpit ring in place. Additionally or alternatively, cockpit spacers may be used maintain suitable inter-rib spacing across the cockpit opening. The cockpit spacers may be made of metal and/or hard plastics. The spacers may include suitable end fixtures (e.g., clamps, hooks, and clasps) so that it can be attached to the kayak ribs. The cockpit spacers may have a telescoping structure, which can be compressed when desired.

Figures 9A, 9B:
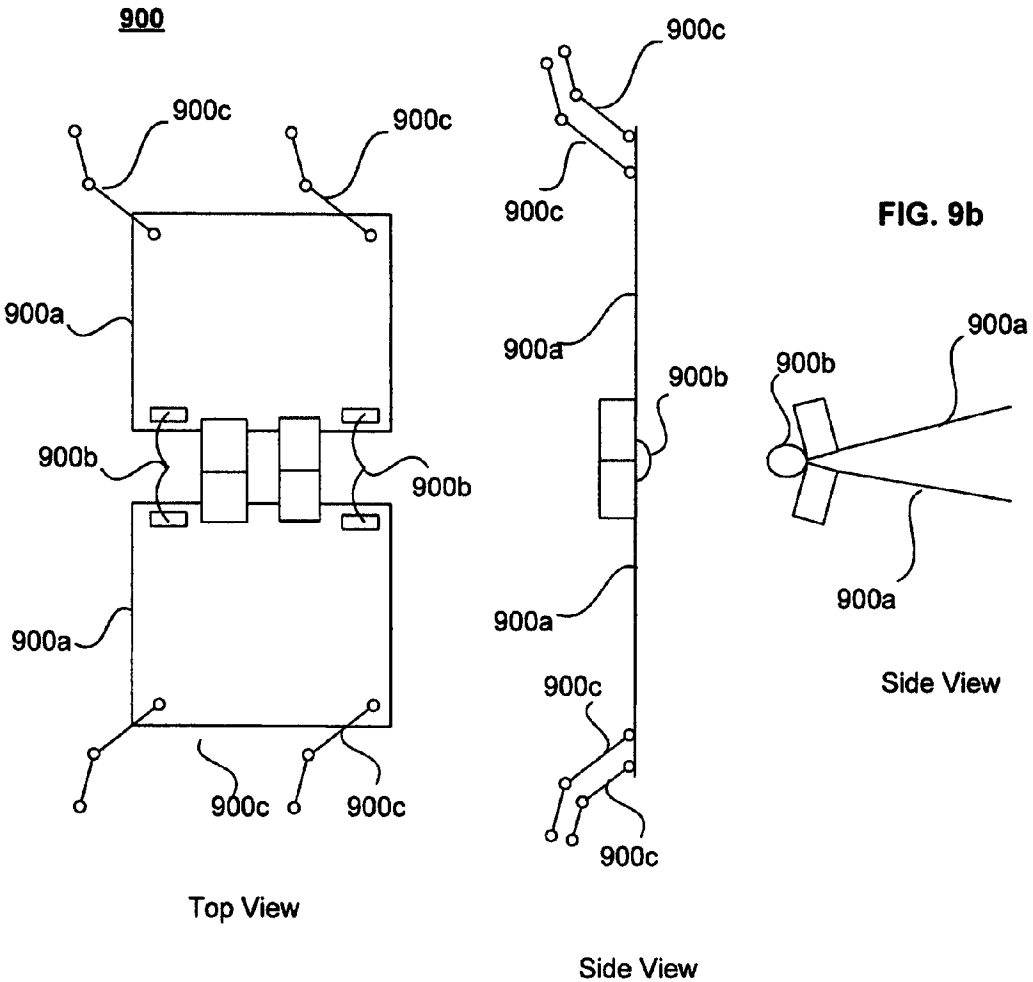
FIGS. 9*a* and 9*b* illustrate a foldable cockpit base that can be incorporated in the portable watercraft, in accordance with the principles of the present invention.

In another variation, the kayak may optionally also include a foldable cockpit base, which is made of rigid material. The foldable cockpit base may define a flat floor in the cockpit space occupied by a paddler in the kayak. FIGS. 9*a* and 9*b* show, for example, a foldable cockpit base 900, which can have an expanded state (FIG. 9*a*) and a collapsed state (FIG. 9*b*). Foldable cockpit base 900 may be constructed from plywood or other lightweight material. Foldable cockpit base 900 may, for example, include two or more plywood sections 900*a* that are connected by hinges 900*b*. When foldable cockpit base 900 is deployed, plywood sections 900*a* extend horizontally providing a relatively flat bottom cockpit space. Hinges 900*b* may be locked in open position using conventional mechanism such as locking blocks or seats to maintain plywood sections 900*a* in an extended position. The locking block or seats may be released or removed to allow hinges 900*b* to be closed so that plywood sections 900*a* may be folded (FIG. 9*b*). Extensible levers, springs, or hinges (e.g., toy chest-like folding hinges 900*c*) may be used to suspend foldable cockpit base 900 from the compressible skeleton or frame of the portable kayak.

Figure 10:
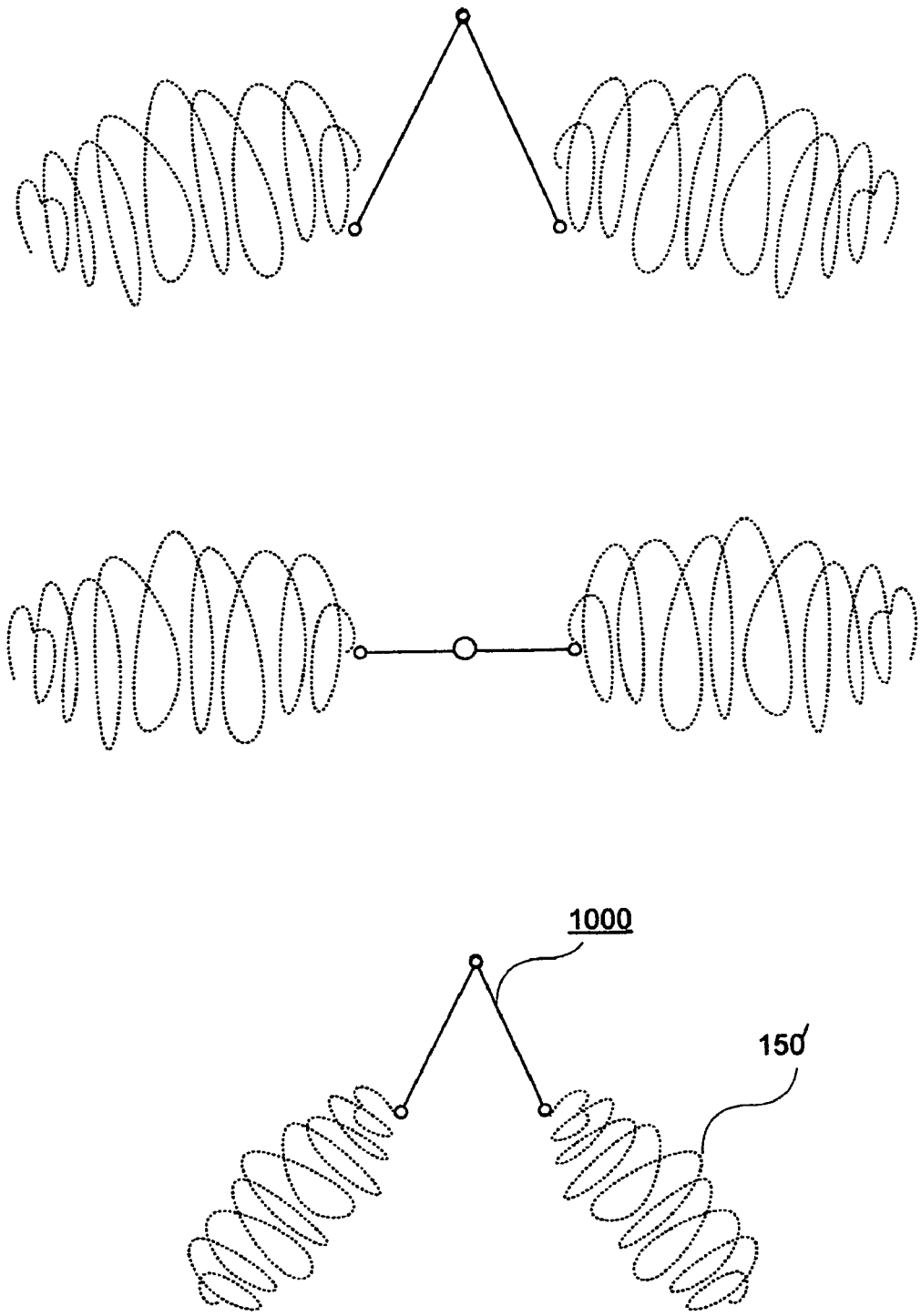
FIG. 10 illustrates an exemplary watercraft frame, which has two telescoping sections and a central joiner section, in accordance with the principles of the present invention. The central joiner section made of foldable straight-line segments.

It will be understood that foldable cockpit base 900 the compressible skeleton or frame of the portable kayak are structurally integrated. A portion of the compressible skeleton or frame may be configured so that it can be folded or collapsed in the same manner as foldable cockpit base 900 to which it is attached. FIG. 10 shows an exemplary telescoping frame 150', which is similar to a compressible skeleton or frame 150 (FIGS 1*a* and 1*b*), but which includes a central joiner section 1000 made of foldable straight line segments that can be expanded to a horizontal position in the same manner as plywood sections 900*a* of foldable cockpit base 900 are expanded to a horizontal position (FIG. 9*a*).

Figure 11B:
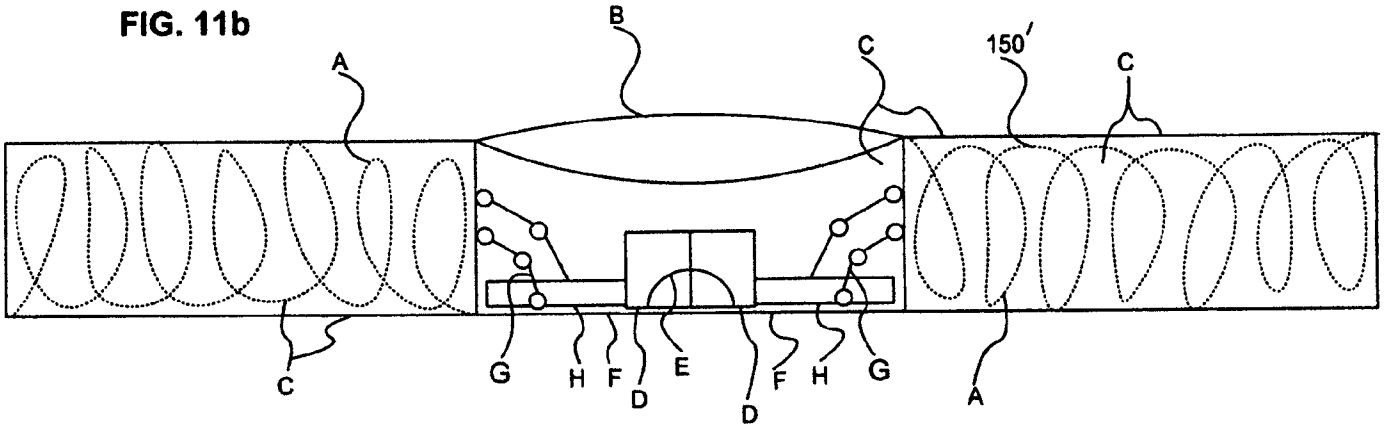
FIGS. 11*a* and 11*b* illustrate views of an exemplary portable kayak based on the watercraft frame of FIG. 10, and in which a foldable cockpit base is installed in accordance with the principles of the present invention.
Figure 11A:
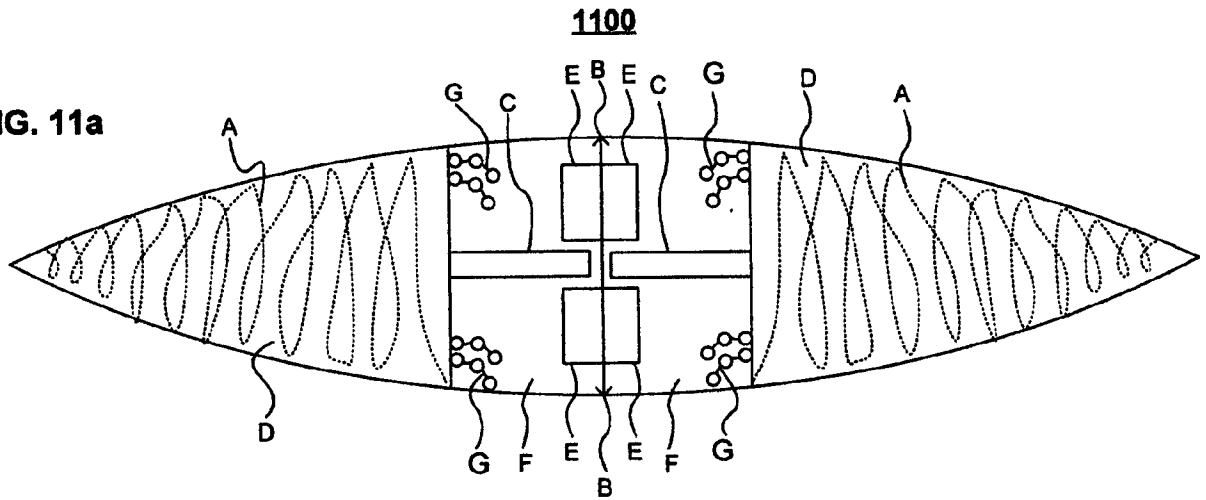
Figure 12A:
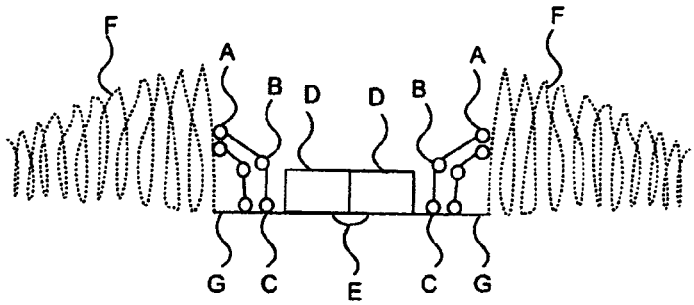
FIGS. 12*a*–12*c* illustrate details of the attachment and the operation of the cockpit base to the frame of the portable kayak of FIGS. 11*a* and 11*b*, in accordance with the principles of the present invention.
Figure 12B:
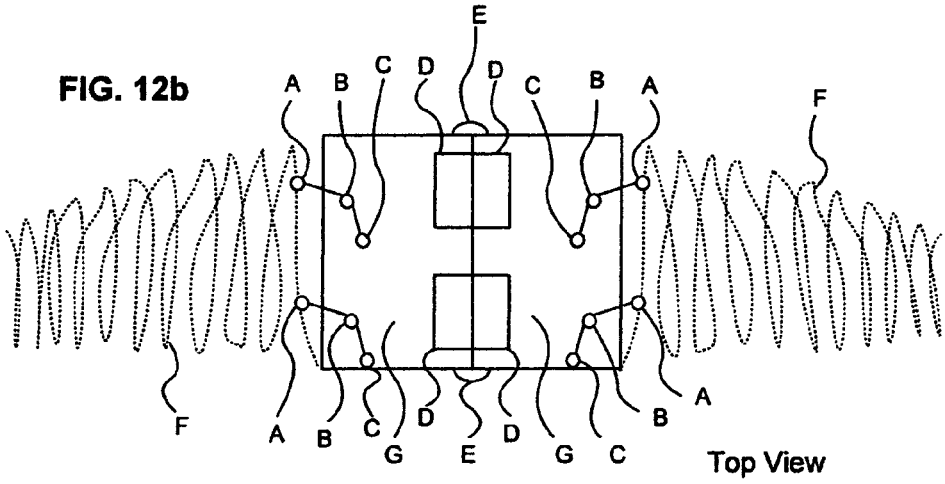
Figure 12C:
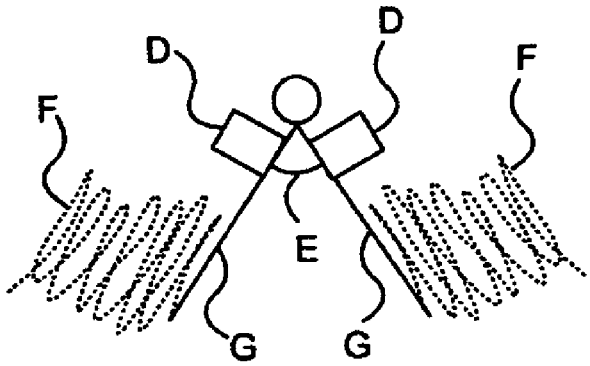

FIGS. 11*a* and 11*b* show designs of an exemplary portable kayak 1100 with compressible skeleton 150' in which foldable cockpit base 900 may be optionally installed. Foldable cockpit base 900 provides a firm flat bottom cockpit space for a paddler in kayak 1100. Kayak 1100 also has a removable cockpit seat or block 1102 which may be optionally placed on the cockpit floor for use by the paddler as a seat. FIGS. 12*a*–12*c* show details of the attachment of cockpit base 900 to compressible skeleton 150'.

Figure 13:
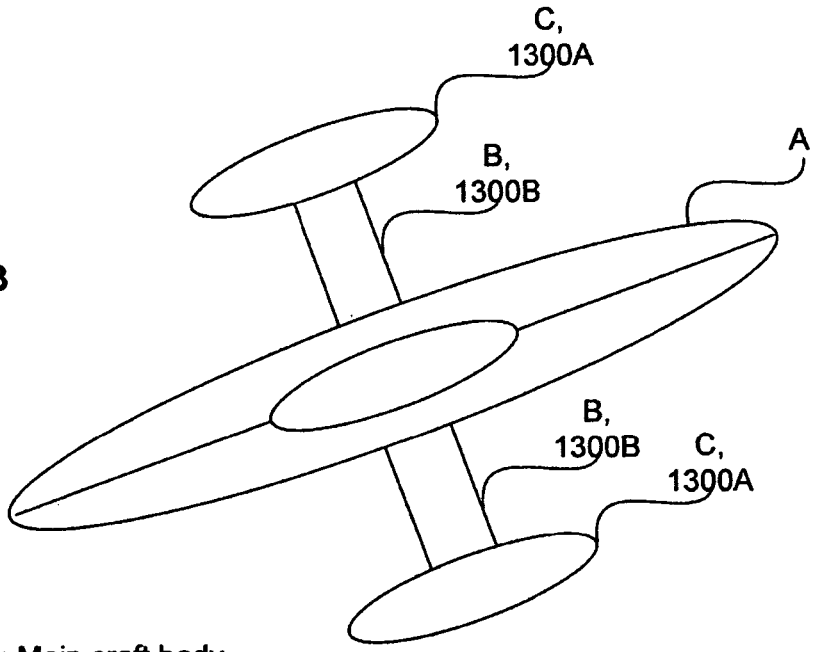
FIG. 13 illustrates a portable kayak to which flotation devices are attached in accordance with the principles of the present invention.

For increased water stability in use, some variations of the portable kayak may include additional flotation devices or structures. FIG. 13 shows, for example, a portable kayak 1300 to which flotation devices 1300A (e.g., runners) that are connected to the main body of the kayak by flotation arms 1300B. Flotation devices 1300A and flotation arms 1300B may be foldable or hinged so they can be folded to a smaller size when not the kayak is not deployed for use. Such flotation devices 1300A and floatation arms 1300B may be permanently attached to the kayak structure. Alternatively, flotation devices 1300A and flotation arms 1300B may be detachable so that they can be transported as separate units and attached to the kayak when desired.

The foregoing merely illustrates the principles of the invention. Various modifications and alterations to the described embodiments will be apparent to those skilled in the art in view of the teachings herein. It will thus be appreciated that those skilled in the art will be able to devise numerous watercraft designs which, although not explicitly described herein, embody the principles of the invention and are thus within the spirit and scope of the invention.

The invention claimed is:

1. A portable watercraft, comprising:

a skeletal frame that can be expanded by one of a telescoping action, a spring-like action, or a combination thereof to a full length state for deployment of the watercraft in water and which can be conversely compressed by one of a telescoping action, a spring-like action or a combination thereof to a shorter length state for storage and porting of the watercraft over land; and a skin integrated with the skeletal frame so that it expands and compresses as the skeletal frame is expanded and compressed, respectively, wherein the skeletal frame includes at least one of a telescoping structure, a spring-like structure, and a combination thereof, each structure having a structure length, and wherein an increase in structure length obtained respectively due to one of a telescoping action, a spring-like action or a combination thereof is a major fraction of the full length state of the skeletal frame expanded for deployment of the watercraft in water.

2. The portable watercraft of claim 1 wherein the skeletal frame comprises a spring-like structure.

3. The portable watercraft of claim 1 wherein sleeves are disposed about element of the skeletal frame and the skin is attached to the sleeves.

4. The portable watercraft of claim 1 wherein the skeletal frame and the skin are mutually attached by adhesives.

5. The portable watercraft of claim 1 wherein the skeletal frame comprises a telescoping pole.

6. The portable watercraft of claim 1 further comprising a cockpit ring.

7. The portable watercraft of claim 1 whose weight is less than about 50 lbs.

8. The portable watercraft of claim 1 wherein the skin comprises at most three seams.

9. A portable watercraft having an overall length from bow to stern for deployment in water, the portable water craft comprising:

an integrated skeletal frame having an extended length of about the overall length of the portable craft, wherein the integrated skeletal frame is compressible by one of a telescoping action, a spring-like action or a combination thereof in the direction between bow and stern to a compressed length for portage, and wherein the difference in the extended length and the compressed length that is obtained entirely by one of a telescoping action, a spring-like action, or a combination thereof is a major fraction of the overall length.

10. The portable watercraft of claim 9 wherein the integrated skeletal frame comprises a telescoping pole.

11. The portable watercraft of claim 10 further comprising a rope and pulley arrangement for operating the telescoping pole.

12. The portable watercraft of claim 9 wherein the integrated skeletal frame comprises a spring-like section.

13. The portable watercraft of claim 9 further comprising a skin permanently attached to the skeletal frame.

14. The portable watercraft of claim 13, wherein the skin comprises a cockpit opening about which a cockpit ring is disposed.

15. The portable watercraft of claim 9 wherein the skeletal frame is configured to receive a cockpit floor.

16. The portable watercraft of claim 9 that has dimensions of about ten feet by three feet when deployed for water use and has dimensions of about three feet by three feet when compressed.

17. The portable watercraft of claim 9 further comprising floatation devices for water stability.

18. The portable watercraft of claim 9 configured as a portable kayak kit, comprising a back pack; and the portable kayak.

19. The portable kayak kit of claim 18 wherein the portable kayak weighs less than about 50 lbs.

20. The portable kayak kit of claim 18 wherein the portable kayak comprises a cockpit ring and a cockpit floor.

* * * * *